US005979066A

United States Patent [19]

Buschle

[11] Patent Number: 5,979,066

[45] Date of Patent: Nov. 9, 1999

[54] COMPASS

[76] Inventor: Richard Dieter Buschle, Rua Sacopa 109/901, 22471-180 Rio de Janeiro, Brazil

[21] Appl. No.: 08/894,237

[22] PCT Filed: Jan. 25, 1996

[86] PCT No.: PCT/BR96/00003

§ 371 Date: Sep. 15, 1997

§ 102(e) Date: Sep. 15, 1997

[87] PCT Pub. No.: WO96/22889

PCT Pub. Date: Aug. 1, 1996

[30] Foreign Application Priority Data

Jan. 26, 1995 [BR] Brazil ..... 9500331
Jan. 31, 1995 [DE] Germany ..... 195 03 005

[51] Int. Cl.[6] ..... B43L 9/02

[52] U.S. Cl. ..... 33/27.02; 33/27.031

[58] Field of Search ..... 33/27.02, 27.031, 33/27.032, 558.01, 558.02, 558.04, 558.2, 558.4

[56] References Cited

U.S. PATENT DOCUMENTS 730,388 6/1903 Oberbeck ..... 33/27.02
1,734,958 11/1929 Audrieth ..... 33/27.02
4,858,326 8/1989 Warwicker ..... 33/27.02
5,398,577 3/1995 Pierce ..... 33/558.01

FOREIGN PATENT DOCUMENTS 2536343 5/1984 France ..... 33/27.02

*Primary Examiner*—Christopher W. Fulton
*Attorney, Agent, or Firm*—Max Fogiel

[57] ABSTRACT

The compass according to the invention comprises a compass top and two compass legs (1,2) mounted rotatably in the compass top, the compass top comprising two top-halves (3,4). Provided in each compass-top half is a bearing pivot (19) for respectively bearing a compass leg, as well as a counter-core (20) which, in the assembled state, engages in the bearing pivot of the corresponding compass-top half. A permanent and even radial frictional clamping is thus produced. At the same time, the counter-cores bring about a limitation to the opening of the compass due to corresponding in the compass legs.

24 Claims, 11 Drawing Sheets

COMPASS

BACKGROUND OF THE INVENTION

So-called single-journal compasses are known from DE-C 29 11 015 and GB-C 1,170,243. In these single-journal compasses having a compass top in which the compass legs rotate together about a pivot formed as a screw, the screw causes axial frictional clamping at the apex of the connected compass legs, in that, in interaction with a counter-nut or with a counter-thread, the friction surfaces of the legs are squeezed together.

Both the previously known compasses require the use of relatively expensive metal screws. Additionally, the two previously known compasses do not have straight guiding of the compass top; the compass top thus assumes different angles relative to the drawing plane depending on the angle of opening of the compass legs. This lack of straight guiding makes use of the compass difficult since the compass top constantly has to be positioned during use.

A drawing instrument, in particular a drawing compass or dividers or callipers, is known from DE-C 27 33 978. In this case, an axial frictional clamping is likewise produced by a large-area leg top and by a screw with a counter-nut. Furthermore, an additional punching plate made of steel is provided for the straight guiding of the compass top.

The three parts mentioned, screw, counter-nut and punching plate, make the compass expensive and lead to complicated assembly of the individual parts of the compass. Apart from the three parts mentioned which consist of metal, the compass legs must also be made of metal since the compass legs are of narrow design; the use of plastic material for the compass legs is virtually ruled out since these would bend in a non-permissible manner during use.

A compass is already known from DE-C 25 23 046, in which two tightening screws each form a pivot for each of the two compass arms.

Compasses, whose top and legs are attached using a screw, are known from the following publications: DE-A 1411830, DE-C 243002, DD 280072, DE-A 4201854, DE-U 1863371, U.S. Pat. No. 4,858,32E, DE-A 2922999.

The use of screws for attaching the compass leg and the compass top firstly entails the disadvantage of the relatively high cost of the screws. Moreover, when using screws, the axial frictional clamping they cause can only be adjusted or readjusted with difficulty. Moreover, there is the risk that compasses with self-tapping screws without a counter-nut become overturned, thus losing the requires frictional clamping and becoming unusable.

SUMMARY OF THE INVENTION

Setting out from this prior art, the invention is based on the technical problem of providing a compass of simple construction which can be both manufactured and operated in a simple manner.

The compass according to the invention can be manufactured without the use of screws and counter-nuts or counter-threads. Readjustment of the frictional clamping during use of the compass is not required owing to its construction.

In particular, in the compass according to the invention, an essentially radial frictional clamping is formed between the compass legs and the compass top, while an axial component of the frictional clamping formed is of only subsidiary importance In particular, the bearing pivots of the compass top ace of slightly conical design so that, when the compass legs are mounted on the compass top, the bearing pivots engage with slight press-fitting in the corresponding bores of the compass legs. The conical design of the bearing pivots also facilitates the manufacture of the compass top by the injection moulding method.

According to the invention, (first) spreading cores can be introduced into the counter-cores which engage in the bearing pivots and additionally spread the latter apart in the end position of the bearing pivots in the counter-cores so that the connection is non-releasable.

A further advantageous embodiment is characterized in that, in the region of the compass-top half, the width of each compass leg is such that it essentially corresponds to the width of the compass-top half. Bending of the compass legs is avoided or reduced due to this relatively wide design of the legs.

According to a further advantageous embodiment, the compass leg has, in the region of the respective counter-core, an opening which is shaped such that it defines the angular adjustment of the compass leg.

According to a further advantageous embodiment, each compass leg has a toothing in the region of an opening which receives the bearing pivot, the teeth of the two compass legs meshing with one another and, in this way, guide the compass top in a straight manner.

According to a further advantageous embodiment of the invention, corresponding centering elements are provided in the compass-top half and in the compass legs. As a result, lateral bending which occure during loading of the leg is absorbed.

According to a further advantageous embodiment of the invention, the tightening tongs which receive a compass point or a writing element are opened laterally so that the compass point and the writing element can be introduced into the tightening tongs or removed from the tightening tongs in a simple manner.

In this regard, a tubular piece can also be provided, which is received by the tightening tongs and which, in turn, receives a writing element or a point. This considerably extends the range of application of the compass; the compass can also be used as dividers or callipers.

BRIEF DESCRIPTION OF THE DRAWINGS

Exemplary embodiments of the invention are now described in greater detail with reference to the following drawings, in which.

DESCRIPTION OF THE PREFERRED EMBODIMENTS

Figure 1:
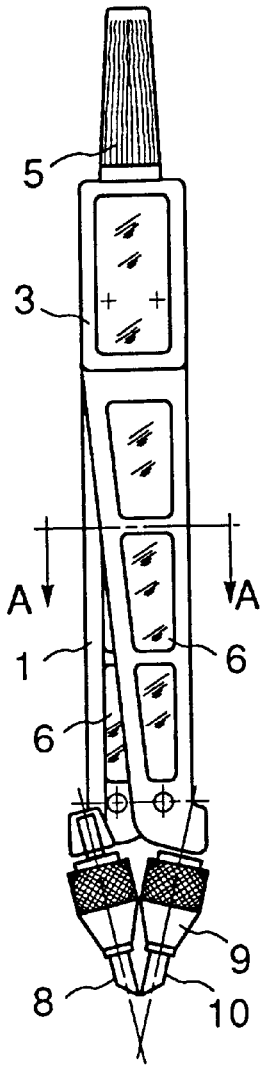
FIG. 1 shows the front view of an exemplary embodiment of a compass in the closed state according to the present invention.
Figure 2:
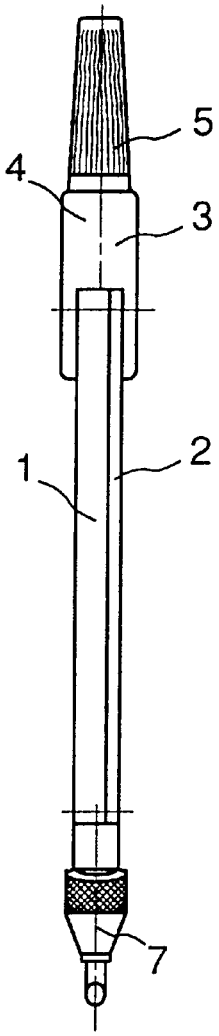
FIG. 2 shows the side view of the same compass.
Figure 3:
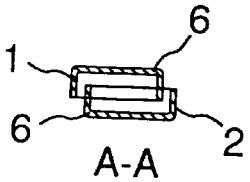
FIG. 3 shows a horizontal section along the line A—A in FIG. 1.

As can be seen from FIGS. 1 to 4, the compass comprises the following main constituent parts: a compass top which is composed of two halves 3 and 4, and a first and a second compass leg 1 and 2 which are both attached in the compass top and are mounted rotatably. A gripping portion 5 is formed on the compass top. The legs are made, in particular, of plastic material and can be reinforced with a profiled insertion part 6 made of steel sheet.

Located at the lower end of the first compass leg 1, that is to say in the region of the foot, are tightening tongs 25 (FIGS. 5, 6, 7 and 9 ) and a threaded sleeve 7 (FIGS. 1, 2 ), which together clamp, for example, a graphite insert 8 or another type of writing element such as, for example, a ball-point pen insert, an ink pen or felt pen, etc. Likewise located at the lower end of the second compass leg 2 are tightening tongs 29 (FIG. 22) and a threaded sleeve 9, which together hold, for example, a compass point 10.

Figure 19:
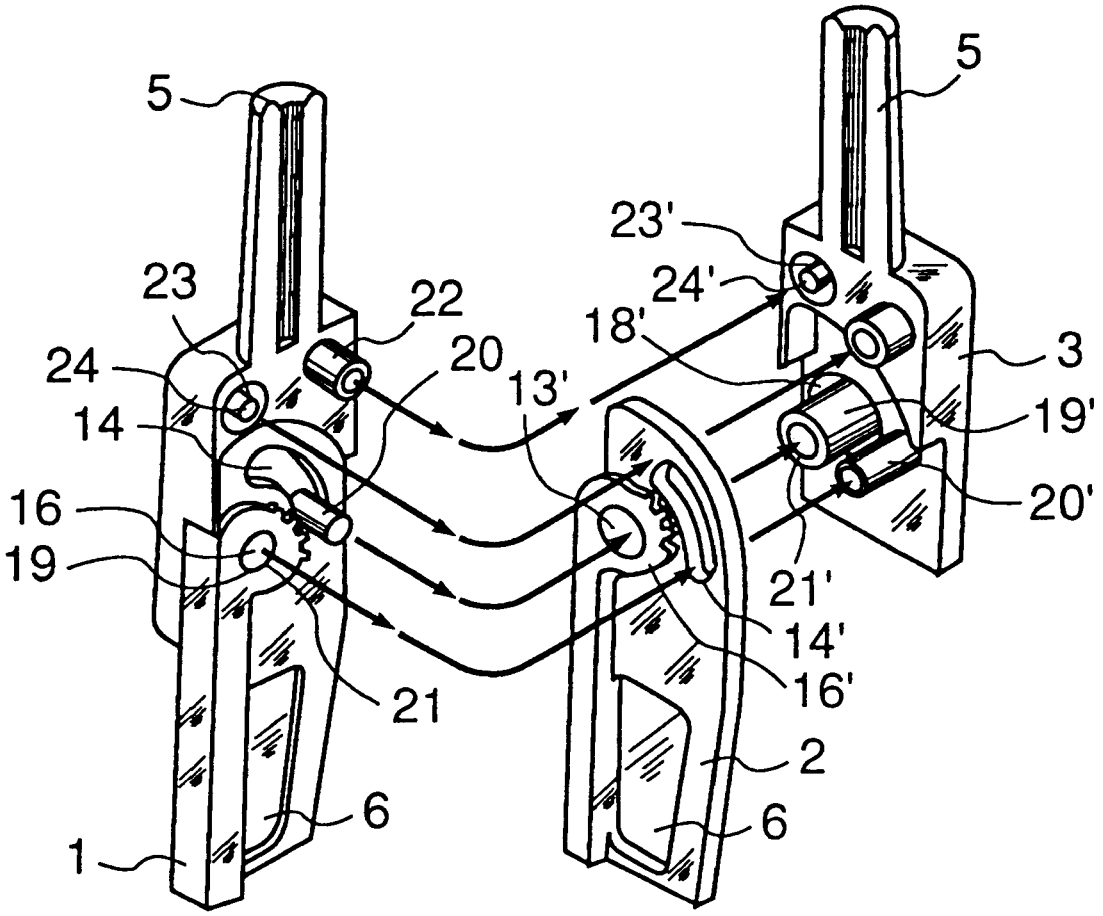
FIG. 19 shows a perspective view which shows the complete assembly of the two compass-top halves with the compass legs, a first leg already having been fitted onto a compass-top half, and another leg being shown in a position prior to its assembly on the other compass-top half.

FIG. 19 shows the design of the compass-top halves 3 and 4 and of the two compass legs 1 and 2 in their top region as well as their assembly. The compass top comprises two compass-top halves 3 and 4. A bearing pivot 19', 19 (concealed in FIG. 19) and a counter-core 20', 20 are provided in each compass-top half 3, 4.

Provision may be made for either a bearing pivot or a counter-core to be present in each of the two compass-top halves. With the compass legs which are arranged on the same bearing pivot, the compass-top halves designed in this manner form a single-journal compass. These compass legs do not have teeth 16, 16' which are described below in conjunction with the compass legs of a two-journal compass.

The bearing pivots 19', 19 engage in the counter-cores 20', 20 the respective other compass leg, preferably with press-fitting, and, in the assembled state, form a virtually non-releasably connection.

Figure 15:
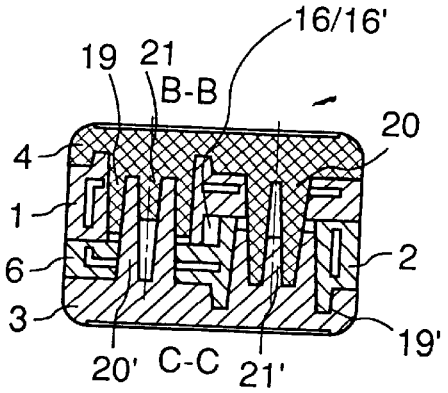
FIG. 15 shows a horizontal section along the line C—C in FIG. 13.
Figure 14:
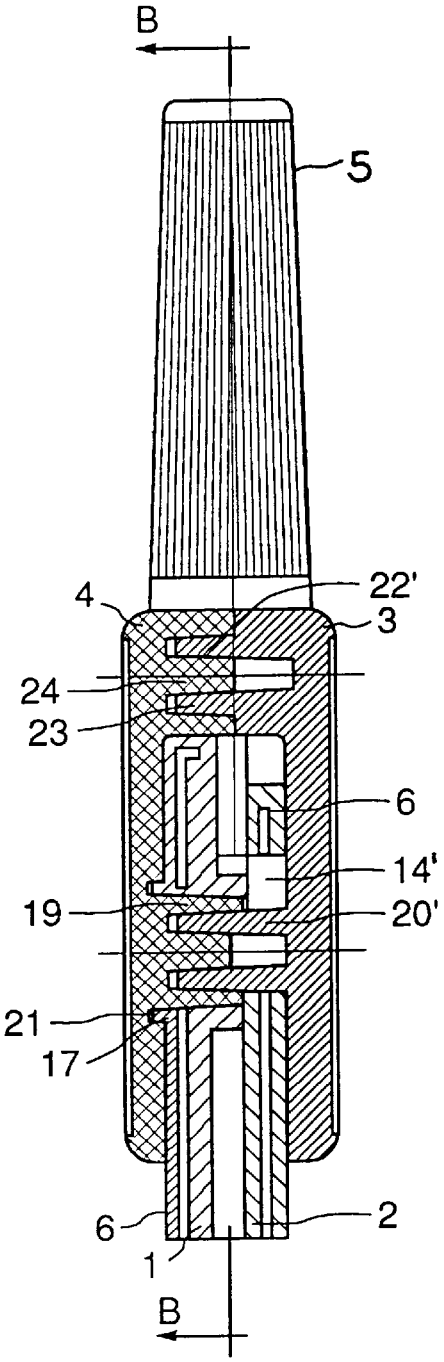
FIG. 14 shows a cross-section along the line A—A in FIG. 13.

The two legs 1 and 2 are arranged relative to one another as shown in FIG. 15. In this case, they come into engagement with their toothing 16 and 16'. The toothing, which has yet to be described serves for the straight guiding of the compass top.

The compass-top halves 3 and 4 are mutually fitted together for assembly. In this case, the bearing pivot 19 of the compass-top half 4 is fitted through an opening (bore) 13 in the upper part the leg 1 and pressed onto the counter-core 20' of the opposite compass-top half 3. In this position, the counter-core 20 of the compass-top half 4 is passed through an opening 14 in the leg (FIG. 19). This opening is shaped such that it defines the angular adjustment of the respective leg.

The bearing pivot 19' of the compass-top half 3 is likewise fitted through the bore 13' in the upper section of the leg 2 and pressed onto the counter-core 20 of the opposite compass-top hall 4. TV counter-core 20' is passed through an opening 14' in the leg 2. An additional (first) spreading core 21 (FIG. 18), which is locate in the internal bore of the bearing pivot 19 of the compass-top half 4, enters into the counter-core 20' of the compass-top half and spreads it apart to form a non-releasable connection of the two compass-top halves 3 and 4. A further (first) spreading core 21' in the bearing pivot 19' also brings about the connection of the two compass-top halves in the same manner. Instead of the spreading cores or even in addition to the spreading cores, provision may be made for the counter-core and bearing pivot to be bonded or welded to one another, for example, thus forming a non-releasable connection.

Owing to the design of the bearing pivot, the counter-core and the spreading core, as described, the two legs 1 and 2 are held so as to be movable without play between the two compass-top halves 3 and 4. An axial frictional clamping is produced between the outer surfaces of the legs and the inner surfaces of the compass-top halves, the absence of play being important for reducing the bending of the legs in the working position. The axial frictional clamping occurring, however, is of secondary importance for the function of the compass according to the invention. Of primary importance in the compass according to the invention is a radial frictional clamping, as will also be described below.

The inner and outer surfaces of the bearing pivots 19, 19', the bores 13, 13' in the legs 1 and 2 and the counter-cores 20, 20' are of slightly conical design. During manufacture, this allows, on the one hand, reliable demoulding of the parts from the injection mould and, on the other hand, assembly which is easy to automate, there being no problem concerning the tolerances required for injection moulding to produce the different diameters of the plug connection. Furthermore, by this design of the said parts, press-fitting between the bearing pivot and the counter-core and slight press-fitting between the bearing pivot and the compass leg are formed.

Figure 18:
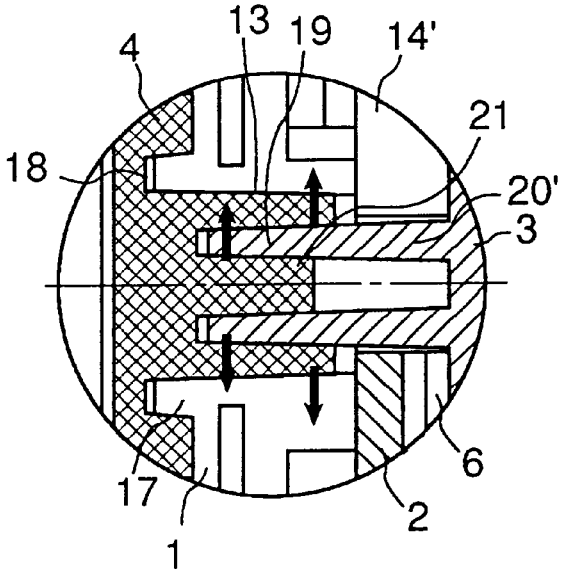
FIG. 18 shows an extract enlargement of a detail of FIG. 14.

In the case of the press-fitting between the bearing pivot 19 and the counter-core 20', a first tension is built up between the inside wall of the bearing pivot 19 and the outside wall of the counter-core 20' (depicted by the pair of arrows on the right in FIG. 18) and a second tension is built up between the outside wall of the spreading core 21 and the inside wall of the counter-core 20' (depicted by the pair of arrows on the left in FIG. 18). The two tensions are superimposed and act on the wall of the bore 13 of the leg 1. On these surfaces, a particularly permanent and even radial frictional clamping is thus produced, which guarantees secure working an all angular settings of the compass. In the compass according to the invention, a permanent, radial frictional clamping is thus formed by elements which, on the one hand, connect the compass-top halves to one another and which, on the other hand, hold the compass legs in the compass-top halves.

When preferably using self-lubricating plastic materials for the compass-top halves, at least for the outside walls of the bearing pivots on the one hand and/or the inside wall of the bores 13, 13' of the compass legs on the other hand, premature wear is avoided and good handling and a long service life are thus guaranteed.

An exemplary embodiment of the compass leg 1 with a plastic-sheathed, for example, metal insertion part 6 is illustrated, in particular, in FIGS. 5 to 12. The insertion part 6 (FIGS. 10 to 12) is profiled (profile 11) and thus gives the plastic legs a particular strength. Insertion parts 6 are provided, in particular, in the region of the leg top and/or in the region between the leg top and the foot. Connection holes 12 in the insertion part 6 receive the plastic material and thus additionally increase the rigidity of the legs.

The bore 13 in the compass leg 1, as already described, is provided for receiving a bearing pivot 19, while an opening 14 which is, for example, partially circular (whose associated centre-point form the bearing pivot 19) serves to guide a counter-core 20 and thus defines the angular adjustment of the leg. The inside wall of the bore 13 can be of conical design, as already described.

Figure 17:
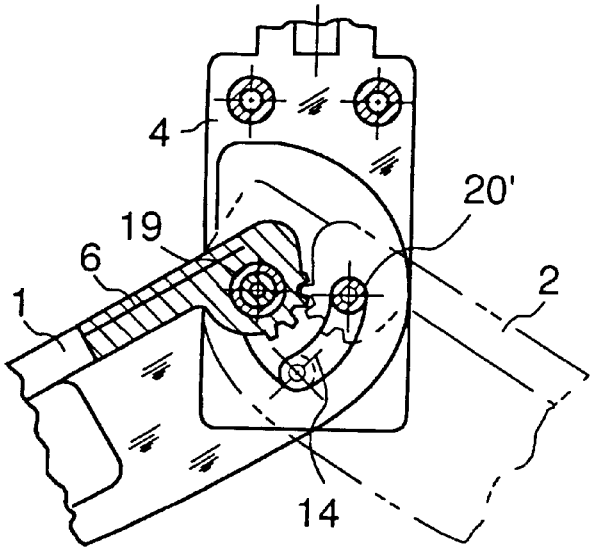
FIG. 17 shows a section similar to FIG. 13, the compass legs being shown in the maximum opened state.

FIG. 17 shows that, in the case of maximum opening of the compass, the counter-core 20 strikes against the opening 14 and thus prevents further opening of the leg 1 and, in interaction with the teeth 16, 16', also of the leg 2. A secure working range of the compass is guaranteed by this simple and, at the same time, sturdy arrangement.

The compass legs 1 and 2 illustrated in the figures have, on the inner side and outer side, a plurality of cutouts 15 which are caused by cores of the injection moulds. These cores hold the insertion part 6 centrally during sheathing and also allow it to become partially visible so that the visual effect of the metal remains intact. On the inner side of the upper end, the leg 1 is fitted with a projecting toothing 16 (FIG. 13) and, on the outer side of the upper end, with a centring projection 17 (FIG. 14) which engages in a corresponding depression 18 (FIG. 18) in the top-half 4 (FIGS. 13 to 18).

The centring projection 17 of the leg 1, which projection is passed into the corresponding depression 18 of the compass-top half 4, prevents bending of the bearing pivot 19 and of the corresponding counter-core 20' since lateral bending of the centring projection 17 occurring during loading of the leg 1 is absorbed. It is true in general that corresponding centring elements are provided in the compass-top halves and in the compass legs, which elements prevent bending of the legs. In particular, the centring elements in the compass-top halves are designed as depressions 18, 18' and the centring elements in the compass legs are designed as centring projections 17, 17'. The depressions and centring projections are of circular design.

In order to avoid or reduce bending of the compass legs, the legs are designed to be relatively wide, it being possible for the width of the legs to correspond in their upper section to the width of the compass top.

Figure 16:
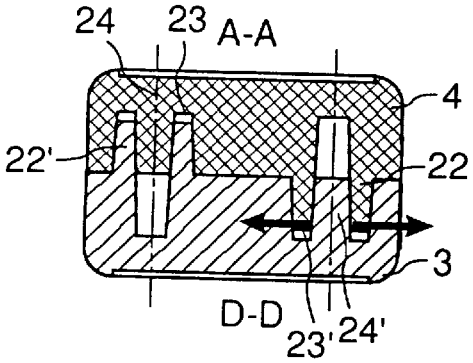
FIG. 16 shows a horizontal section along the line D—D in FIG. 13.

In order to reinforce the connection of the two compass-top halves, two further attachments are provided, as illustrated in FIGS. 13, 14, 16 and 19. These are, for example, journals, in particular hollow journals 22, 22' and receiving elements 23, 23' for the journals 22, 22' (FIGS. 16, 19). The hollow journal 22' of the compass-top half 3 is pressed into the corresponding receiving element (bore) 23 of the compass-top half 4. Additionally, a second spreading core 24 of the compass-top half 4 is inserted into the inner bore of the hollow journal 22', the second spreading core 24 spreading the journal 22' apart to form a non-releasable connection. The journal 22, a bore 23' and a second spreading core 24' interact in an analogous manner (FIG. 16).

Figure 4:
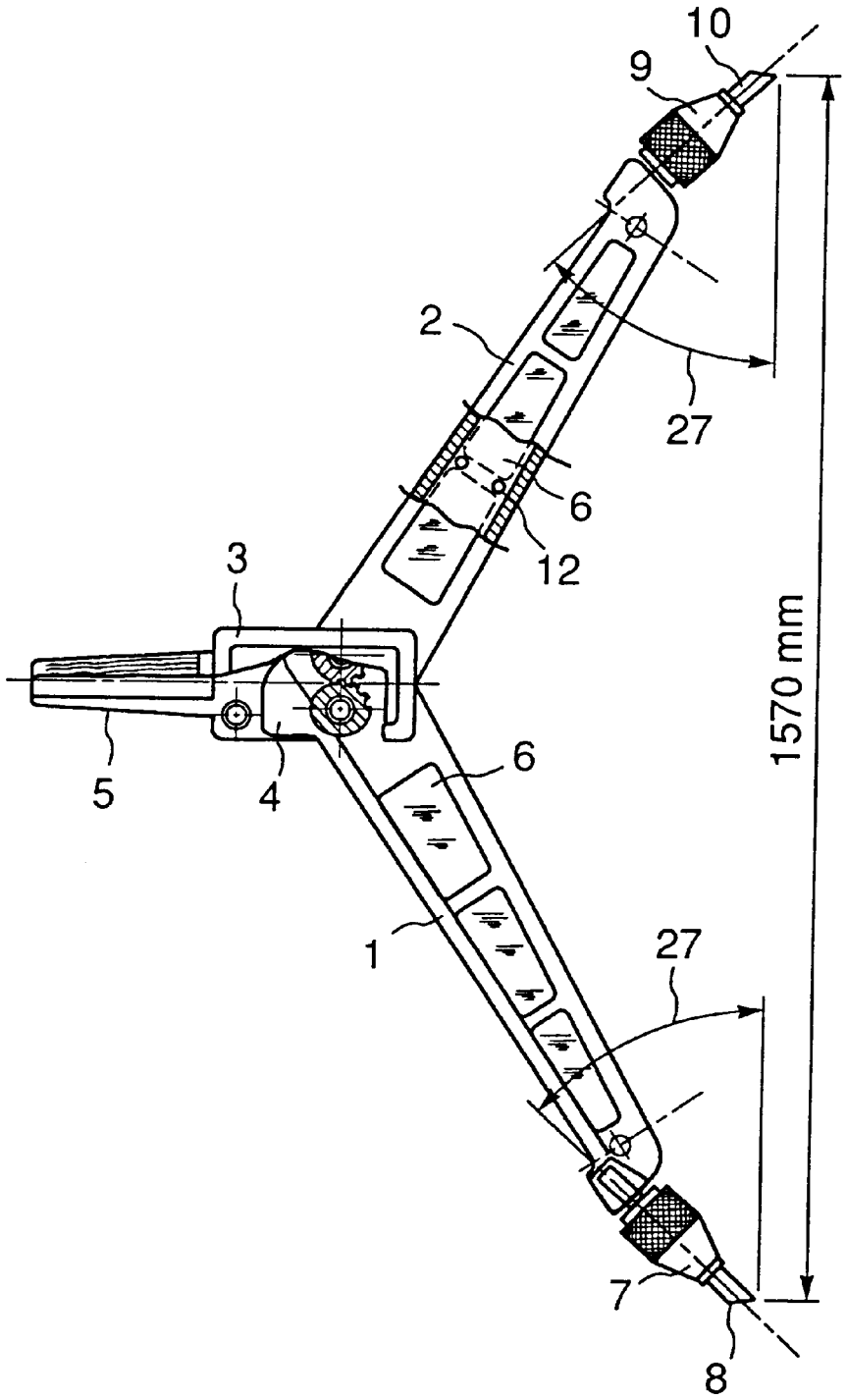
FIG. 4 shows a front view of the same compass in the maxim opened state.
Figure 5:
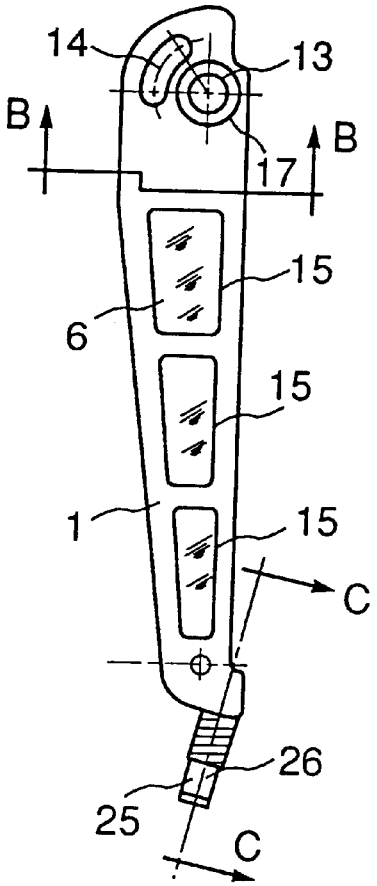
FIG. 5 shows a view of the outer side of a compass leg.
Figure 6:
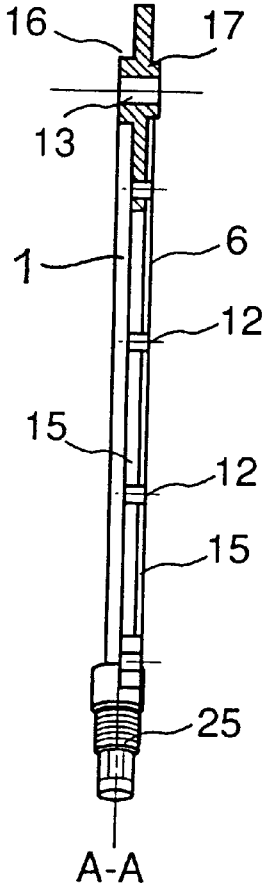
FIG. 6 shows a side view with a partial section along the line A—A in FIG. 7.
Figure 8:
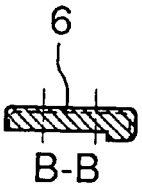
FIG. 8 shows a horizontal longitudinal section along the line B—B in FIG. 5.

As illustrated in FIGS. 5 to 9, tightening tongs 25 with a slot 26 for receiving, for example, a graphite insert 8 are located in the region of the foot, that is to say at the lower end of the leg 1. The tightening tongs 25 are arranged so as to be slightly sloping relative to the leg. This results in a setting angle 27 of about 53° at the maximum opening of the compass. In total, reliable working throughout the entire working range of the compass is guaranteed by this arrangement (FIG. 4).

Figure 9:
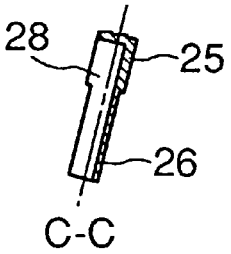
FIG. 9 shows a partial section along the line C—C in FIG. 5.
Figure 7:
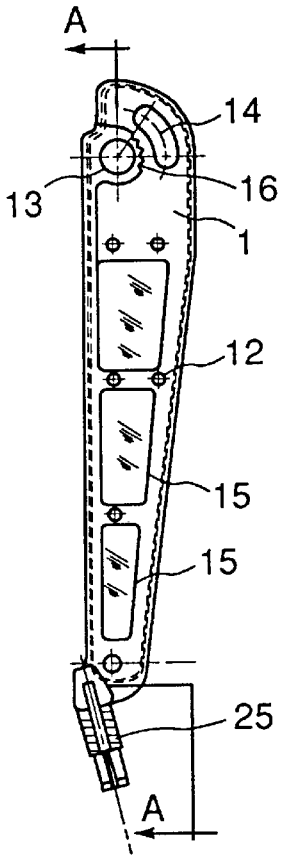
FIG. 7 shows a view of the inner side of the compass leg according to FIG. 5.
Figure 12:
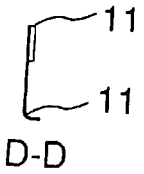
FIG. 12 shows a cross-section along the line D—D in FIG. 10.
Figure 10:
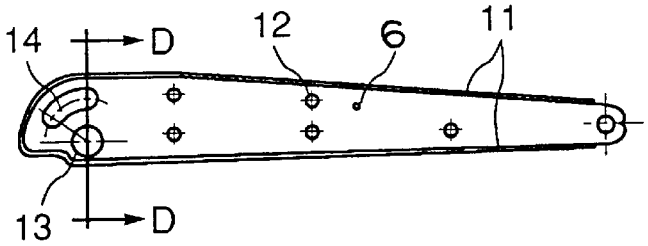
FIG. 10 shows a view of an insertion part which may be a constituent part of a compass leg according to FIG. 5.
Figure 11:
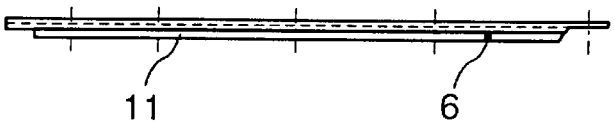
FIG. 11 shows the side view of the insertion part according to FIG. 10.
Figure 13:
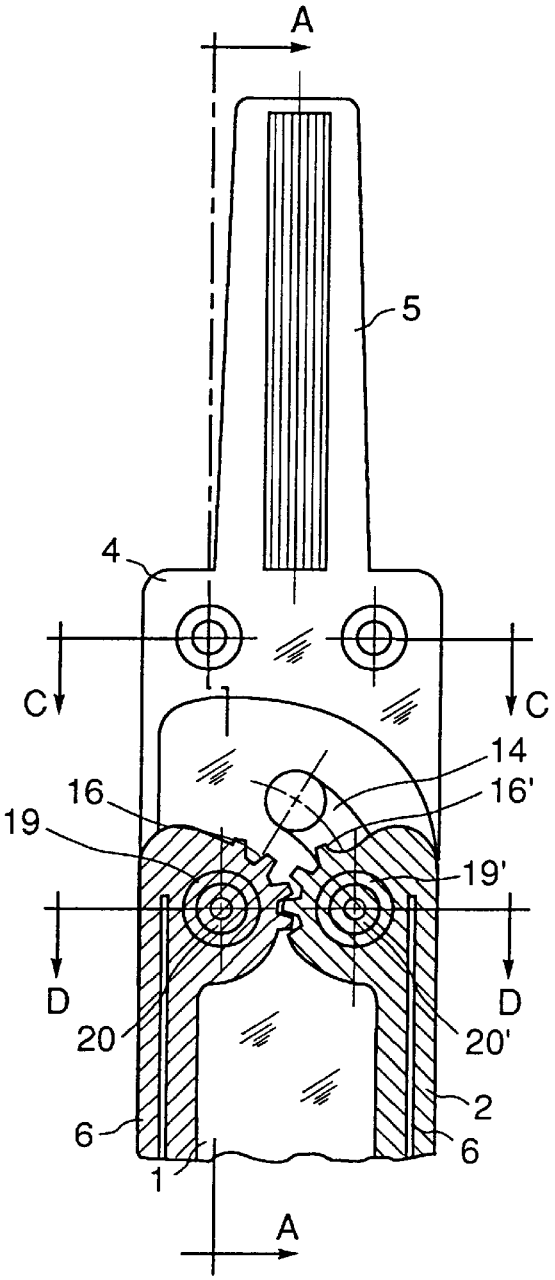
FIG. 13 shows a section along the line B—B of the compass-top halves shown in FIG. 14 and the upper region of the compass legs.
Figure 20:
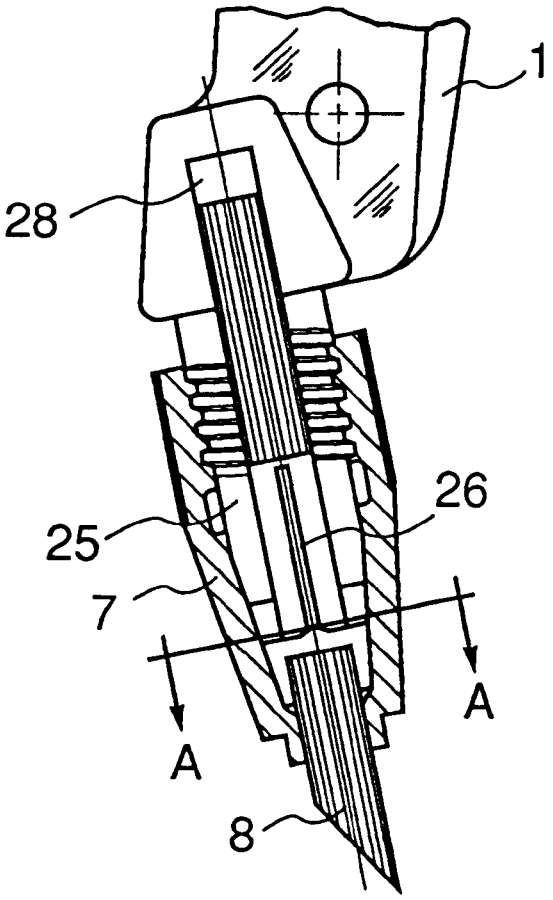
FIG. 20 shows a partial section of tightening tongs with a graphite insert of a compass leg according to the present invention.
Figure 21:
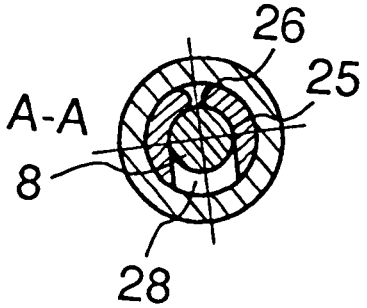
FIG. 21 shows a section along the line A—A in FIG. 20.

FIGS. 20, 21 show that the tightening tongs 25 are open on one side due to a longitudinal groove 28. A section of the open longitudinal groove is illustrated in FIG. 9. In conduction with the threaded sleeve 7 which, when screwed closed, closes the tightening tongs 25 which have a slot 26, the graphite insert 8 is clamped. The lateral opening in the tightening tongs has the advantage that the user of the compass has easy access, for example when exchanging a broken graphite insert. This is not the case in the otherwise customary tightening tongs which have blind bores and are closed continuously at the side. The front bore (=bore which is disposed downwards during use of the compass) of the threaded sleeve 7 centres the graphite insert when the tightening tongs 25 are closed. The opening width of the longitudinal groove 28 is at least equal to the outside diameter of the graphite insert 8 or the writing element.

Figure 22:
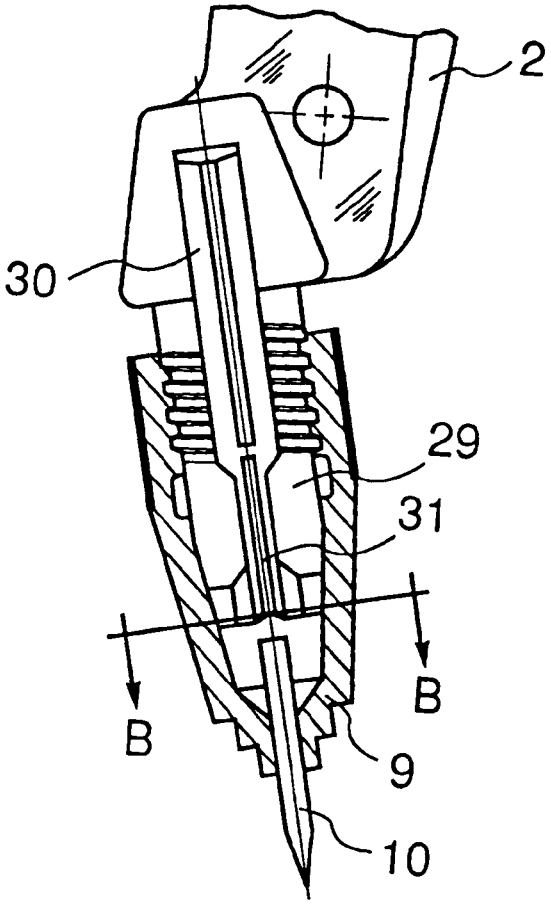
FIG. 22 shows a partial section of the tightening tongs with a compass point of a compass leg according to the present invention.
Figure 23:
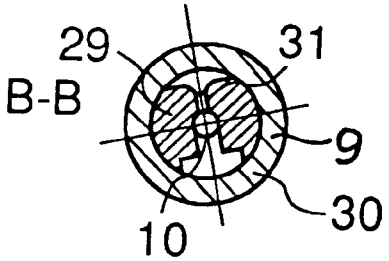
FIG. 23 shows a section along the line B—B in FIG. 22.

The tightening tongs 29 for the compass point 10 shown in FIGS. 22 and 23 likewise has an open longitudinal groove 30 and a slot 31 which, together with the threaded sleeve 9, clamps the compass point 10 when screwed closed and holds it centrally.

Moreover, the arrangement of the open longitudinal grooves 28 and 30 also has the important advantage, in terms of manufacture, of a considerable simplification of the injection mould for the legs and 2 since no complicated lateral slide constructions are necessary.

Owing to the fact that, as is otherwise customary, the compass point does not have to be inserted into the extension of the compass leg from the front, but can be inserted laterally via the open longitudinal groove, it is possible to use a commercially available pin with a head as the compass point. The arrangement of the tightening tongs and the threaded sleeve provided according to the invention allows a short projection over the tip both of the graphite insert and of the compass point. In the case of the graphite insert, this leads to a lesser risk of breakage and, in the case of the compass point, a considerably reduced risk of injury.

Figure 24:
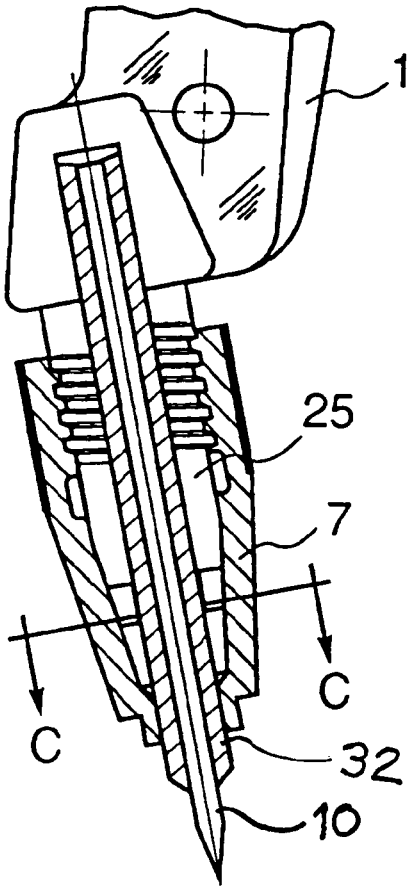
FIG. 24 shows a partial section of tightening tongs of a compass leg with a compass point held in a tubular piece according to the present invention.
Figure 25:
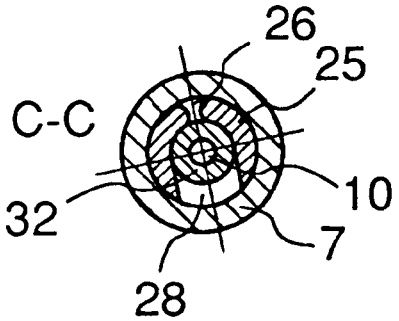
FIG. 25 shows a section along the line C—C in FIG. 24.

The arrangements of the tightening tongs illustrated in FIGS. 24 and 25 is identical to that shown in FIGS. 20 and 21. Instead of the graphite insert, a pin with a tubular piece 32 is used, the tubular piece having the same outside diameter as the graphite insert. The compass can thus also be used as dividers or callipers.

Provision may also be made for the tightening tongs to have an inside diameter which is larger than the outside diameter of customary graphite inserts or customary compass points. The inside diameter of the tightening tongs can be designed for tubular pieces of larger outside diameter, the said tubular pieces receiving compass tips or writing elements (graphite inserts, ballpoint pen inserts, etc.).

The legs can be produced, for example, from a metal alloy based on zinc (e.g. dye-casting zinc alloy "Zamak") which is suitable for dye casting.

The compass according to the invention can also be designed with identical teeth and tightening tongs on both legs, thus enabling the production process to be less expensive. In the case of an identical design of the legs, the two bearing pivots in the compass-top halves are offset in such a way that two sets of teeth engage in one another.

| Items: | |
|---|---|
| 1 | First leg |
| 2 | Second leg |
| 3 | First compass-top half |
| 4 | Second compass-top half |
| 5 | Gripping portion on compass top |
| 6 | Insertion part |
| 7 | Threaded sleeve in leg 1 |
| 8 | Graphite insert/writing element |
| 9 | Threaded sleeve in leg 2 |
| 10 | Compass point |
| 11 | Profile |
| 12 | Connection holes |
| 13, 13' | First opening |
| 14, 14' | Second opening |
| 15 | Cutouts |
| 16, 16' | Toothing |
| 17, 17' | Centring projection |
| 18, 18' | Depression |
| 19, 19' | Bearing pivot |
| 20, 20' | Counter-core |
| 21, 21' | First spreading core |
| 22, 22' | Hollow journal |
| 23, 23' | Bore |
| 24, 24' | Second spreading core |
| 25 | Tightening tongs for graphite insert/writing element |
| 26 | Slot in leg 1 |
| 27 | Setting angle |
| 28 | Longitudinal groove in leg 1 |
| 29 | Tightening tongs for compass point |
| 30 | Longitudinal groove in leg 2 |
| 31 | Slot in leg 2 |
| 32 | Tubular piece |

I claim:

1. A compass comprising: a compass top portion with a first compass top half and a second compass top half; two compass legs mounted rotatably in said compass top portion; a bearing pivot in said first compass top half for supporting said compass legs; a counter-core in said second compass top half and engaging in an assembled state in said bearing pivot, said counter-core being connected non-releasably to said bearing pivot by a spreading core, said compass being free of fastening elements.

2. A compass as defined in claim 1, wherein said two compass legs are comprised of plastic material and have at least one metal member in a region of a top portion of the legs and in a region between a top portion and a foot portion of the legs.

3. A compass as defined in claim 2, wherein said metal member comprises an insertion part.

4. A compass as defined in claim 3, wherein said insertion part has through-holes for receiving said plastic material.

5. A compass as defined in claim 1, wherein said first and second compass top halves form a single-journal compass.

6. A compass as defined in claim 5, wherein said bearing pivot and said counter-core have conically-shaped surfaces.

7. A compass comprising: a compass top portion with a first compass top half and a second compass top half; two compass legs mounted rotatably in said compass top portion; a first bearing pivot in said first compass top half, and a second bearing pivot in said second compass top half; a first counter-core in said first compass top half, a second counter-core in said second compass top half; said first counter-core engaging in an assembled state in said second bearing pivot of said second compass top half; first connecting means for connecting said first counter-core non-releasably to said second bearing pivot; said second counter-core engaging in an assembled state in said first bearing pivot of said first compass top half; second connecting means for connecting said second counter-core non-releasably to said first bearing pivot.

8. A compass as defined in claim 7, wherein said first and said second connecting means are formed by a spreading core in said first and second counter-cores.

9. A compass as defined in claim 8, including a second spreading core in an internal bore of a journal in each compass top half.

10. A compass as defined in claim 7, wherein said counter-cores and said bearing pivots are correspondingly secured to one another.

11. A compass as defined in claim 7, wherein said bearing pivots have adjacent walls, said adjacent walls and the respective counter-cores having correspondingly conical surfaces.

12. A compass as defined in claim 7, wherein in a region of said compass top halves each of said compass legs have a width corresponding to a width of said compass top halves.

13. A compass as defined in claim 12, wherein each compass leg has an opening in the region of the respective counter-core, said opening having a shape defining an angular adjustment of the compass leg.

14. A compass as defined in claim 7, wherein each of said two compass legs has toothing means in a region of an opening receiving the respective bearing pivot, the toothing means on said two legs meshing with one another.

15. A compass as defined in claim 7, wherein each of said compass legs has an opening receiving the respective bearing pivot, said opening having an inside wall of self-lubricating plastic material, said bearing pivot having an outside wall of self-lubricating plastic material in a region of said opening.

16. A compass as defined in claim 7, including centering elements in said compass top halves and in said compass legs.

17. A compass as defined in claim 16, wherein said compass top halves have a depression; and a respective centering projection in each of said compass legs.

18. A compass as defined in claim 7, wherein said compass top halves have attachments.

19. A compass as defined in claim 18, wherein each compass top half has a journal with a receiving element for the respective other compass top half.

20. A compass as defined in claim 7, including tightening tongs on said legs and having a longitudinal groove for receiving a compass point or a writing element in a region of the foot of said legs, said groove having an opening width equal to at least an outside diameter of the compass point or the writing element.

21. A compass as defined in claim 20, wherein said compass point is formed by a pin.

22. A compass as defined in claim 20, including a tubular member in form of a receptacle in a foot of the compass, said tubular member having an outside diameter substantially equal to an outside diameter of the writing element or the-compass point.

23. A compass as defined in claim 22, wherein said tubular member receives the compass point or the writing element.

24. A compass as defined in claim 23, wherein the compass point is formed by a pin.

* * * * *